US010066626B2

(12) United States Patent
Tabata

(10) Patent No.: US 10,066,626 B2
(45) Date of Patent: Sep. 4, 2018

(54) ELECTRIC PUMP

(71) Applicant: MIKUNI CORPORATION, Chiyoda-ku, Tokyo (JP)

(72) Inventor: Shingo Tabata, Odawara (JP)

(73) Assignee: MIKUNI CORPORATION, Tokyo (JP)

( * ) Notice: Subject to any disclaimer, the term of this patent is extended or adjusted under 35 U.S.C. 154(b) by 152 days.

(21) Appl. No.: 14/417,350

(22) PCT Filed: Jul. 26, 2013

(86) PCT No.: PCT/JP2013/070326
§ 371 (c)(1),
(2) Date: Jan. 26, 2015

(87) PCT Pub. No.: WO2014/017636
PCT Pub. Date: Jan. 30, 2014

(65) Prior Publication Data

US 2015/0211519 A1 Jul. 30, 2015

(30) Foreign Application Priority Data

Jul. 26, 2012 (JP) ..... 2012-166381

(51) Int. Cl.
*F04C 18/344* (2006.01)
*F04C 29/04* (2006.01)
(Continued)

(52) U.S. Cl.
CPC ..... *F04C 29/04* (2013.01); *F04C 18/344* (2013.01); *F04C 18/3446* (2013.01);
(Continued)

(58) Field of Classification Search
CPC .... F04C 18/344; F04C 29/045; F04C 29/005; F04C 29/0085; F04C 11/008;
(Continued)

(56) References Cited

U.S. PATENT DOCUMENTS 3,468,260 A * 9/1969 Belden ..... F01C 21/10 417/410.3
4,231,728 A * 11/1980 Hertell ..... F04C 29/023 418/79
(Continued)

FOREIGN PATENT DOCUMENTS

CN 102345603 A 2/2012
DE 102006058980 A1 6/2008
(Continued)

OTHER PUBLICATIONS

Japanese Notice of Reasons for Rejection corresponding to Application No. 2012-166381; date May 31, 2016, with English abstract.
(Continued)

*Primary Examiner* — Nathan Zollinger
(74) *Attorney, Agent, or Firm* — Cantor Colburn LLP

(57) ABSTRACT

An electric pump is provided, which may include a motor unit including a rotation shaft, and a pump unit including a rotor having a vane groove accommodating a vane and coupled with the rotation shaft, and including a pump plate including an external wall portion and a cam ring having a cam surface on which the vane slides, and a bottom lid portion provided in the pump plate and being integrally formed with the external wall portion and the cam ring, and a connection unit being provided between the external wall portion and the cam ring to connect the external wall portion and the cam ring and protruding in a direction away from the bottom lid portion, and the connection unit is integrally formed with the external wall portion, the cam ring, and the bottom lid portion.

12 Claims, 13 Drawing Sheets

(51) Int. Cl.
*F04C 29/00* (2006.01)
*F04C 25/02* (2006.01)

(52) U.S. Cl.
CPC ..... *F04C 29/0078* (2013.01); *F04C 29/0085* (2013.01); *F04C 25/02* (2013.01); *F04C 2230/603* (2013.01); *F04C 2230/91* (2013.01); *F04C 2240/30* (2013.01); *F04C 2240/60* (2013.01); *F04C 2270/12* (2013.01)

(58) Field of Classification Search
CPC ..... F04C 2240/30; F04C 2240/40; F04C 2240/803; F04C 18/3446; F04C 29/04; F04C 29/0078; F04C 25/02; F04C 2230/603; F04C 2240/60; F04C 2270/12; F01C 21/0809; F01C 21/0836; F01C 21/10; F01C 21/104
See application file for complete search history.

(56) References Cited

U.S. PATENT DOCUMENTS

| | | | | |
|---|---|---|---|---|
| 5,149,257 | A * | 9/1992 | Iio | F01C 21/106 418/178 |
| 5,924,856 | A | 7/1999 | Murayama et al. | |
| 6,022,204 | A | 2/2000 | Murayama et al. | |
| 7,393,192 | B2 * | 7/2008 | Wood | F01C 21/08 418/148 |
| 2005/0214153 | A1 | 9/2005 | Citro et al. | |
| 2010/0074773 | A1 * | 3/2010 | Watanabe | F01C 21/10 417/410.3 |
| 2010/0111730 | A1 * | 5/2010 | Peterreins | F04D 13/0626 417/423.7 |

FOREIGN PATENT DOCUMENTS

| | | | | | |
|---|---|---|---|---|---|
| EP | 2410181 | A2 | | 1/2012 | |
| GB | 1398953 | A | * | 6/1975 | F04B 49/022 |
| GB | 2486007 | A | * | 6/2012 | F01C 21/08 |
| JP | 59192887 | A | | 11/1984 | |
| JP | S59192887 | A | | 11/1984 | |
| JP | 62060994 | A | | 3/1987 | |
| JP | 62159786 | A | | 7/1987 | |
| JP | S63230983 | A | | 9/1988 | |
| JP | 02241997 | A | | 9/1990 | |
| JP | H0742951 | B2 | | 5/1995 | |
| JP | H09158868 | A | | 6/1997 | |
| JP | 2001221181 | A | | 8/2001 | |
| JP | 1980069180 | U | | 5/2008 | |
| JP | 2009007938 | A | | 1/2009 | |
| JP | 2011117391 | A | | 6/2011 | |
| JP | 2011214519 | A | | 10/2011 | |

OTHER PUBLICATIONS

International Search Report corresponding to Application No. PCT/JP2013/070326; dated Oct. 29, 2013, with English translation.
Chinese Notification of the First Office Action corresponding to Application No. 201380049796.3; dated Mar. 18, 2016, with English translation.
Extended European Search Report corresponding to Application No. 13823542.9-1608/2896835 PCT/JP2013/070326; Mar. 3, 2016.
Chinese Second office Action corresponding to Patent No. 201380049796,3; dated Nov. 2, 2016, with English translation.
EP Notice of Allowance "Rule (3)" corresponding to Application No. 13823542.9-1616; dated Feb. 21, 2017.

* cited by examiner

ELECTRIC PUMP

This is the U.S. national stage of application No. PCT/JP2013/070326, filed on Jul. 26, 2013. Priority under 35 U.S.C. § 119(a) and 35 U.S.C. § 365(b) is claimed from Japanese Application No. 2012-166381, filed Jul. 26, 2012, the disclosure of which is also incorporated herein by reference.

TECHNICAL FIELD

The present invention relates to, for example, an electric pump for causing a negative pressure chamber of a brake booster of a vehicle to be in a negative pressure.

BACKGROUND ART

A vane-type vacuum pump has been used in a vehicle such as a car in order to, for example, cause a negative pressure chamber of a brake booster to be in a negative pressure. Examples of such vacuum pumps include those shown in PTLs 1 to 4. Pumps shown in PTL 1 and PTL 2 have such a structure that main members such as a cam ring (cylinder) accommodating a roller in an inner peripheral side hollow portion, a plate (main bearing) for sealing one of opening portions of the cam ring and a plate (sub bearing) and the like for sealing the other of opening portions of the cam ring are disposed in a case.

In a pump as shown in PTL 3, a ditch-shaped groove portion is provided between an inner periphery and an outer periphery of a center case accommodating a rotor in an inner peripheral side hollow portion. The opening portion of the groove portion is sealed with the side cover, so that a sealed chamber is formed. In this case, the sealed chamber is used as a diffusion chamber of a muffler.

In a pump as shown in PTL 4, a feature of forming a casing main body using a material of a high degree of thermal conductivity can be disclosed.

CITATION LIST

Patent Literature

[PTL 1] JP 2-241997 A (FIG. 1, FIG. 8)
[PTL 2] DE 102006058980 (FIG. 4)
[PTL 3] JP 62-60994 A (Claim 1, lower right column on page 2, and the like)
[PTL 4] JP 2011-214519A (Abstract, paragraph 0018, and the like)

SUMMARY OF INVENTION

Technical Problem

By the way, in particular, in a case of a dry type vane-type electric pump that does not use any oil, the temperature rises significantly in the cam ring when the electric pump is activated. On the other hand, when the electric pump is activated, and the degree of vacuum increases, then the flow rate of the intake air decreases. Therefore, the heat radiation effect cannot be achieved by discharging the intake air, and accordingly, the heat radiation property is deteriorated. When the temperature rises in the cam ring because of such deterioration in the heat radiation property, the wear of the vane is accelerated.

In this case, in the pumps as described in PTL 1 and PTL 2, the cam ring and the pump cover accommodating the cam ring are made of separate members. For this reason, the thermal conductivity between the cam ring and the pump cover is likely to be blocked, and it is difficult to efficiently radiate the heat generated at the sliding portion and the heat of compression of gasses such as air and the like generated according to the pumping operation to the outside of the pump.

On the other hand, the center case constituting the pump described in PTL 3 includes an inner peripheral side cylindrical portion, an external peripheral side cylindrical portion, and a thin connection unit connecting the inner peripheral side cylindrical portion and the external peripheral side cylindrical portion in the diameter direction. The inner peripheral side cylindrical portion, the external peripheral side cylindrical portion, and the connection unit are constituted by a single member integrally formed, and therefore, the heat generated at the sliding portion is basically transmitted smoothly from the inner peripheral side cylindrical portion via the connection unit to the external peripheral side cylindrical portion.

However, in the inner peripheral side cylindrical portion, the heat transmission path becomes long at a portion of the center case opposite side to the intake hole in the diameter direction, and accordingly, there is a significant deviation in the heat radiation property of the inner peripheral side cylindrical portion. Therefore, in the pump described in PTL 3, there is a significant deviation in the heat radiation property at the inner peripheral side cylindrical portion, and the heat radiation efficiency is reduced locally. Therefore, in such sliding portion where the heat radiation efficiency is reduced locally, the wear of the vane is accelerated more greatly than in other sliding portions. Therefore, even with the pump described in PTL 3, it is difficult to suppress the wear of the vane and improve the durability and the reliability.

On the other hand, for example, PTL 4 discloses formation of the casing main body using a material having a high degree of heat conductivity such as aluminum. However, PTL 4 discloses the feature that the cam ring (cylinder unit) is made of the same material as the rotor, but does not disclose the feature that it is made of a material having a high degree of thermal conductivity such as aluminum. Therefore, it is difficult to improve the heat radiation property of the cam ring. Therefore, it is also difficult to suppress the wear of the vane and improve the durability and the reliability.

If the cam ring is made of an aluminum material having a high degree of thermal conductivity, there is a problem in that the sliding property between the vane and the cam surface of the cam ring is significantly deteriorated. Due to such sliding property, it is difficult to make the cam ring using an aluminum material, and it is likely to employ such configuration that the cam ring is not made of aluminum and only the casing main body is made of aluminum as shown in PTL 4.

Further, the electric pump disclosed in PTL 1 and PTL 2 employs such an arrangement that the cam ring and the plate are made separately and are arranged in the axial line direction. Therefore, the size of the portion of the electric pump where the pump cam ring and the plate are provided (hereinafter referred to as a pump body) is relatively large. Therefore, when the size from the bottom portion side of the motor to the end surface of the pump cover is determined, the pump unit gets into the inside of the pump cover due to a large size of the pump body, and accordingly, this reduces the internal space (expansion space) of the pump cover where the gas discharged from the pump unit can stay. For this reason, the effect of reducing the noise generated by the pump unit is low.

This invention is made in view of the above circumstances, and an object of the present invention is to provide an electric pump capable of achieving at least one of: (1) enhancement of the heat radiation efficiency during operation of the pump; (2) reducing the deviation of the heat radiation property; (3) improving the sliding property between a cam ring and a vane; and (4) reducing the noise generated by a pump unit.

Solution to Problem

In order to solve the above problem, according to a first aspect of the present invention, an electric pump is provided, which includes a motor unit including a rotation shaft, and a pump unit including a rotor having a vane groove accommodating a vane and coupled with the rotation shaft, and including a pump plate including an external wall portion and a cam ring having a cam surface on which the vane slides, and a bottom lid portion provided in the pump plate and being integrally formed with the external wall portion and the cam ring, and a connection unit being provided between the external wall portion and the cam ring to connect the external wall portion and the cam ring and protruding in a direction away from the bottom lid portion, and the connection unit is integrally formed with the external wall portion, the cam ring, and the bottom lid portion.

Another aspect of the present invention is based on the invention explained above, and the connection unit is preferably provided on every predetermined angle along a peripheral direction of the cam ring.

Further, another aspect of the present invention is based on the invention explained above, and an end surface of the connection unit at a protruding side from the bottom lid portion is preferably disposed to be located at a side closer to an end surface of a protruding side of the cam ring than the bottom lid portion.

Another aspect of the present invention is based on the invention explained above, and when the pump plate is seen in a top view, a central line of at least one of a plurality of the connection units passes a closest portion where the rotor is closest to the cam surface, and further passes a center of the cam ring.

Further, another aspect of the present invention is based on the invention explained above, and the pump plate is preferably made of an aluminum-based member.

Another aspect of the present invention is based on the invention explained above, and the cam surface is preferably formed with a coating film for improving a sliding property of the vane, and this coating film is preferably a hard plating film of which harness is harder than that of the cam ring other than the cam surface.

Further, another aspect of the present invention is based on the invention explained above, and the coating film is preferably provided so that the hardness of the coating film when a temperature of the cam ring increases is harder than that of the vane.

Another aspect of the present invention is based on the invention explained above, and at least the cam ring of the pump plate is preferably made of an Al—SiC composite material made by adding SiC powder to aluminum or aluminum alloy.

Further, another aspect of the present invention is based on the invention explained above, and at a side of the pump unit opposite to the motor unit, a cover is preferably attached in a state of covering, and this cover is attached to a side surface of the external wall portion at a side away from the motor unit, and inside of the cover, an expansion space is preferably formed between the cover and the pump unit.

Another aspect of the present invention is based on the invention explained above, and the cover is preferably provided with a plurality of ribs in a protruding manner from an inner wall of the cover, and a plate member is preferably disposed at an end side of protrusions of the ribs, and a closed space is formed as being separated from the expansion space by the plate member, the ribs, and the inner wall of the cover, and the plate member is preferably provided with a hole which allows for communication between the expansion space and the closed space.

Further, another aspect of the present invention is based on the invention explained above, and the ribs are preferably provided on a top surface portion of the cover facing the pump unit at a position away from the pump unit, and the closed space is preferably formed by attaching the plate member to the top surface portion.

Another aspect of the present invention is based on the invention explained above, and the plurality of ribs are preferably arranged in a lattice manner on the top surface portion.

Advantageous Effects of Invention

According to the present invention, an electric pump can achieve at least one of: (1) enhancement of the heat radiation efficiency during operation of the pump; (2) reducing the deviation of the heat radiation property; (3) improving the sliding property between a cam ring and a vane; and (4) reducing the noise generated by a pump unit.

DESCRIPTION OF EMBODIMENTS

Hereinafter, an electric pump according to an embodiment of the present invention will be described with reference to the drawings.

<1. Configuration of Electric Pump 10>

Figure 1:
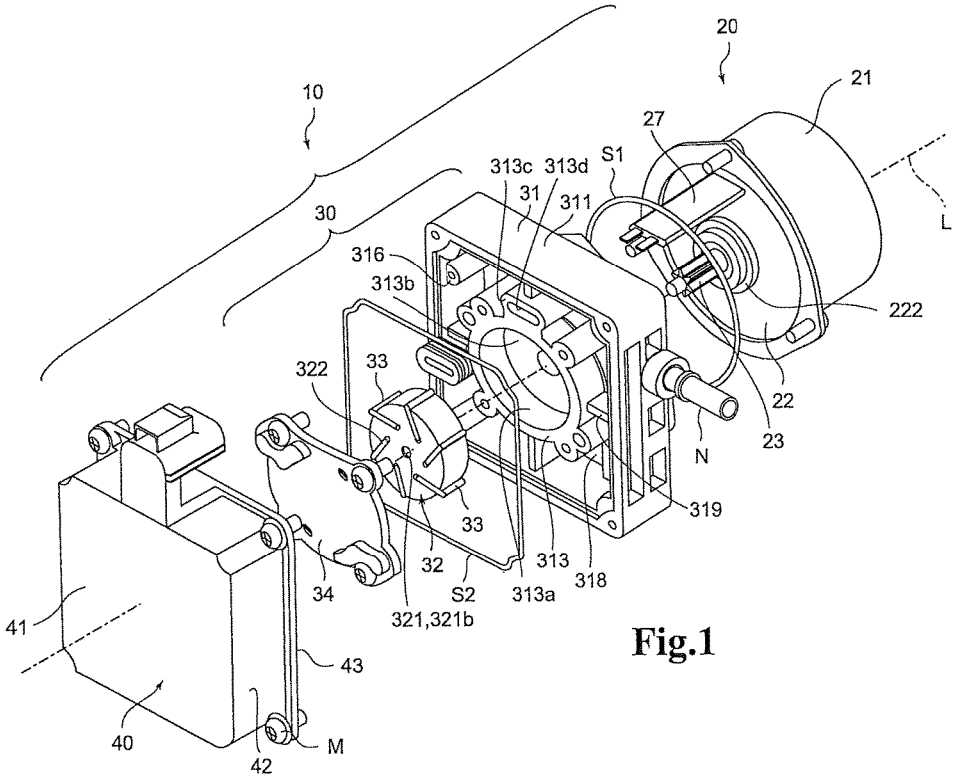
FIG. 1 is an exploded perspective view showing a configuration of an electric pump according to an embodiment of the present invention as seen from a cover side.
Figure 2:
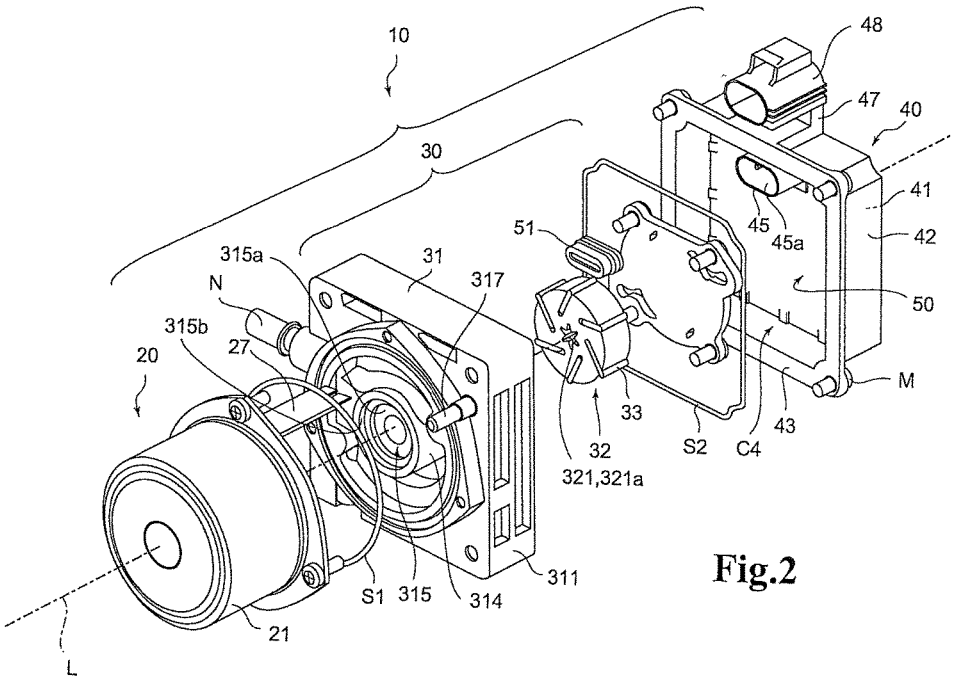
FIG. 2 is an exploded perspective view showing the configuration of the electric pump according to an embodiment of the present invention as seen from a motor unit side.
Figure 3:
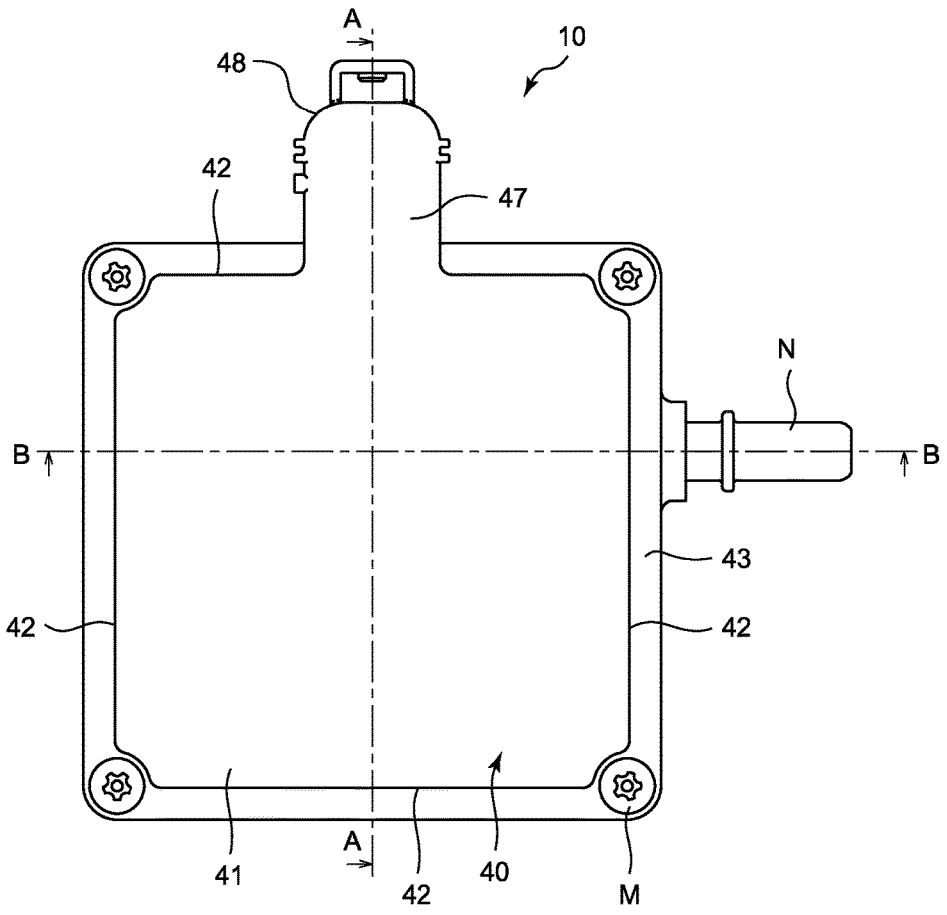
FIG. 3 is a front view of the electric pump of FIG. 1 as seen from the cover side.

FIG. 1 is an exploded perspective view showing a configuration of an electric pump 10 as seen from the cover 40 side. FIG. 2 is an exploded perspective view showing the configuration of the electric pump 10 as seen from the motor unit 20 side. FIG. 3 is a front view showing the configuration of the electric pump 10 as seen from the cover 40 side. As shown in FIGS. 1 to 3, the electric pump 10 includes the motor unit 20, a vane pump unit 30, and the cover 40 as main components.

Figure 4:
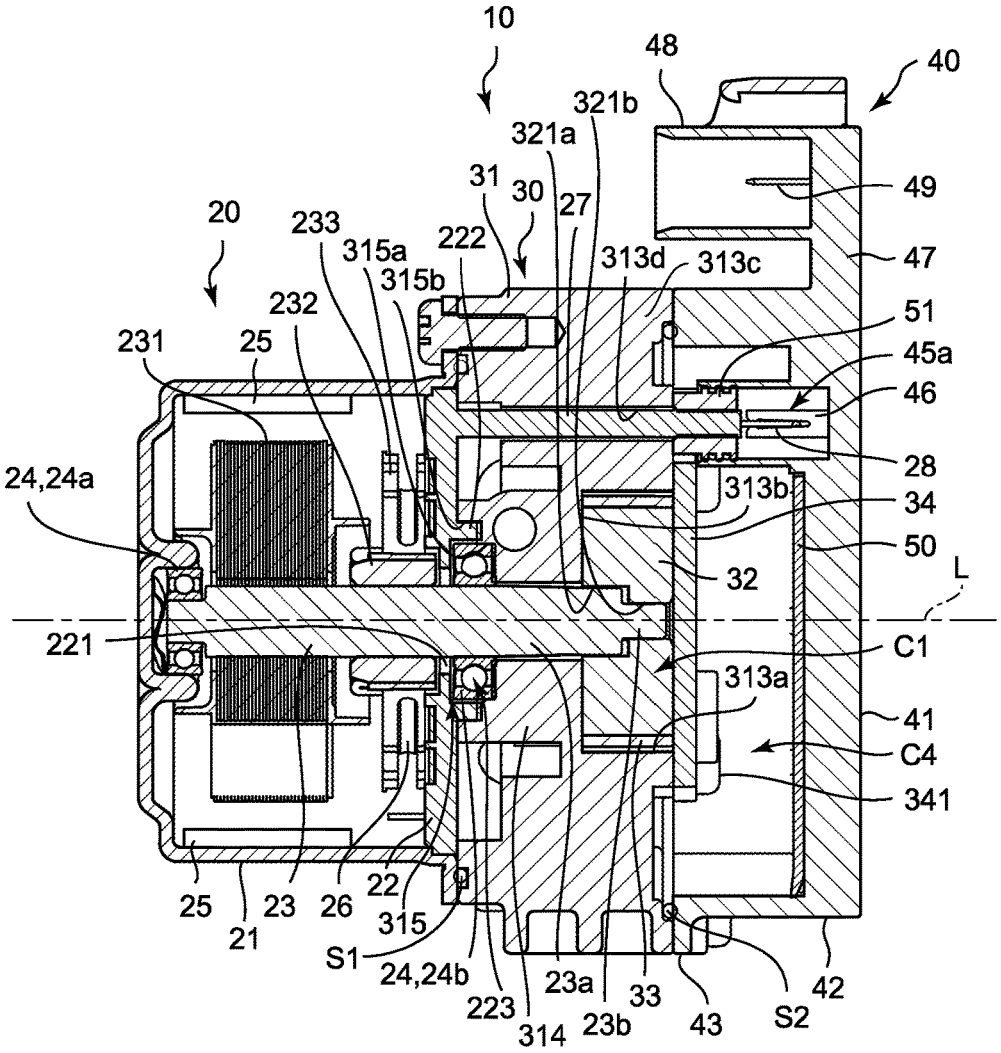
FIG. 4 is a cross sectional view illustrating a configuration of electric pump taken along line A-A of FIG. 3 when it is seen from the side surface side.
Figure 5:
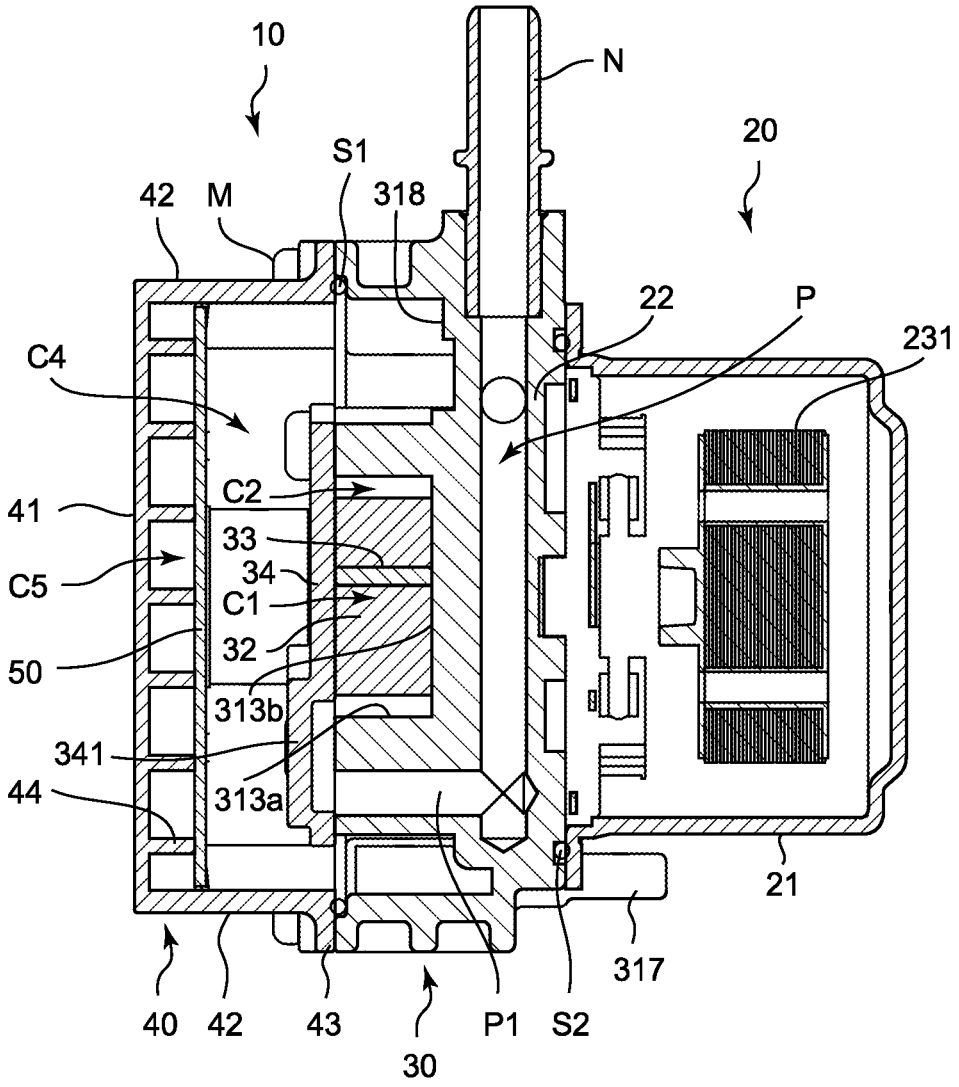
FIG. 5 is a cross sectional view illustrating a configuration of electric pump taken along line B-B of FIG. 3 when it is seen from the side surface side.
Figure 6:
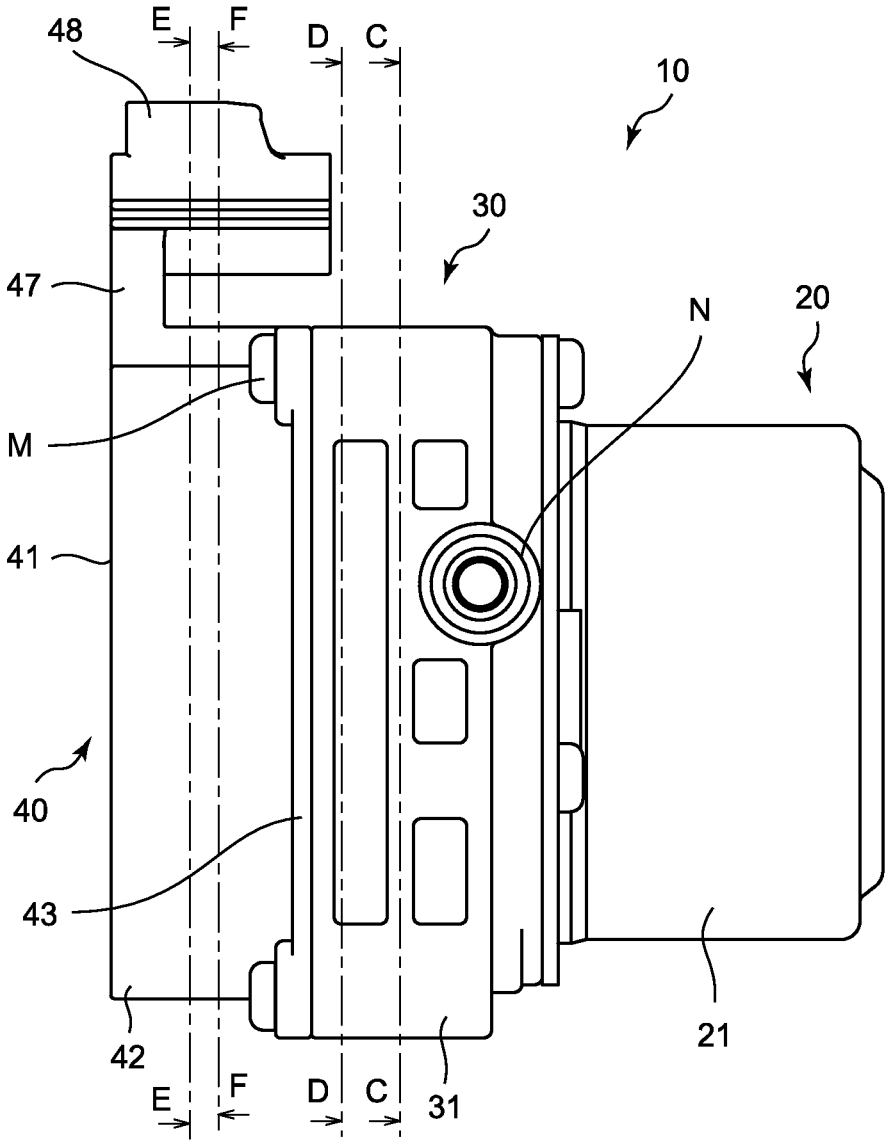
FIG. 6 is a side view of the electric pump of FIG. 1.
Figure 7:
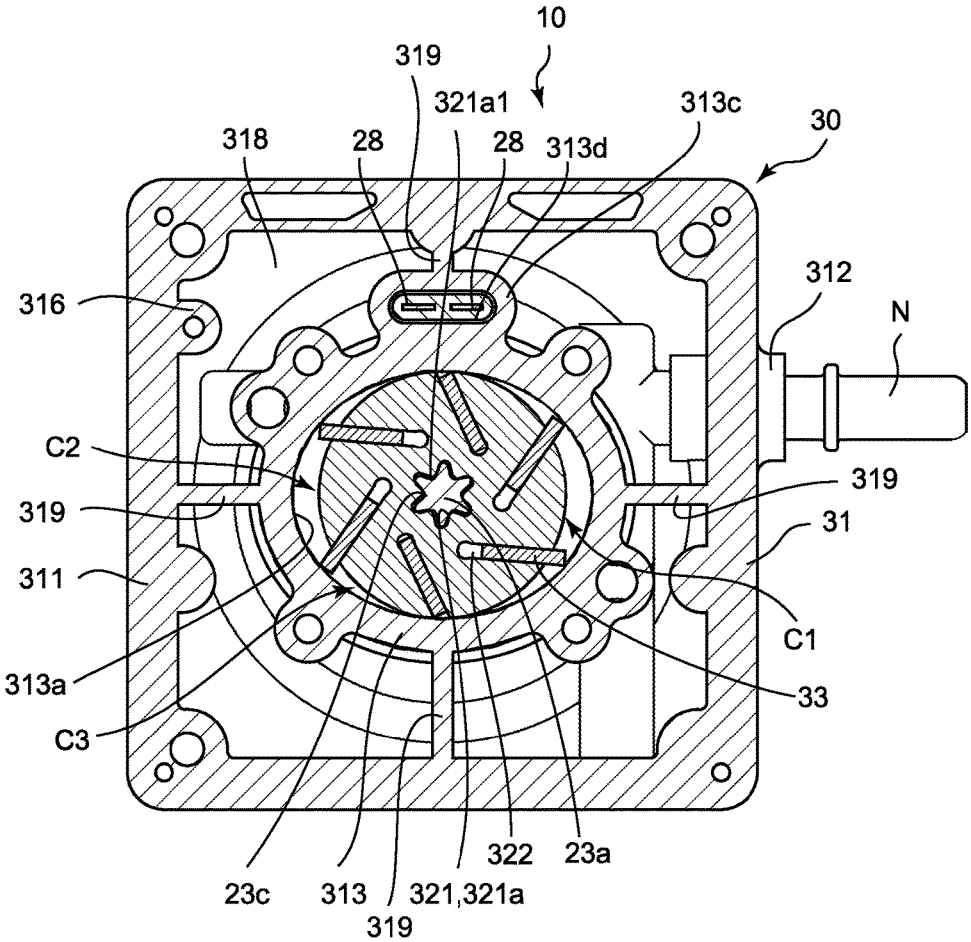
FIG. 7 is a cross sectional view illustrating a configuration of electric pump taken along line C-C of FIG. 6 when it is seen from the front surface side (cover side).
Figure 8:
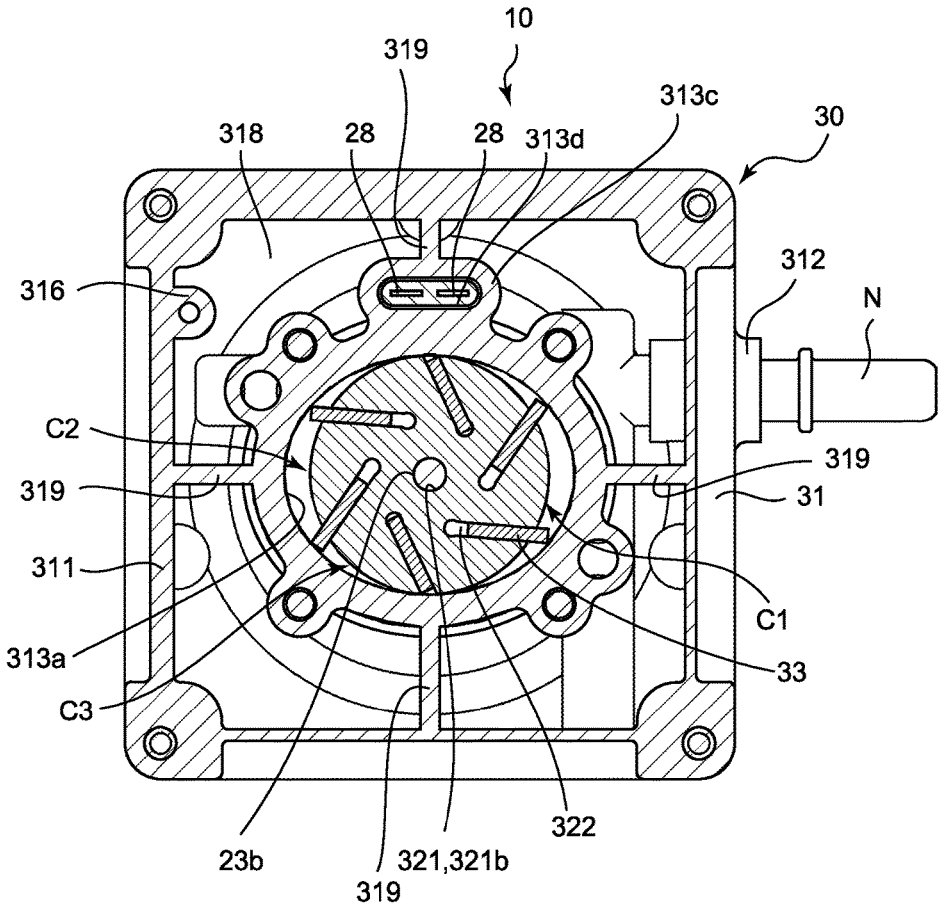
FIG. 8 is a cross sectional view illustrating a configuration of electric pump taken along line D-D of FIG. 6 when it is seen from the front surface side (cover side).
Figure 9:
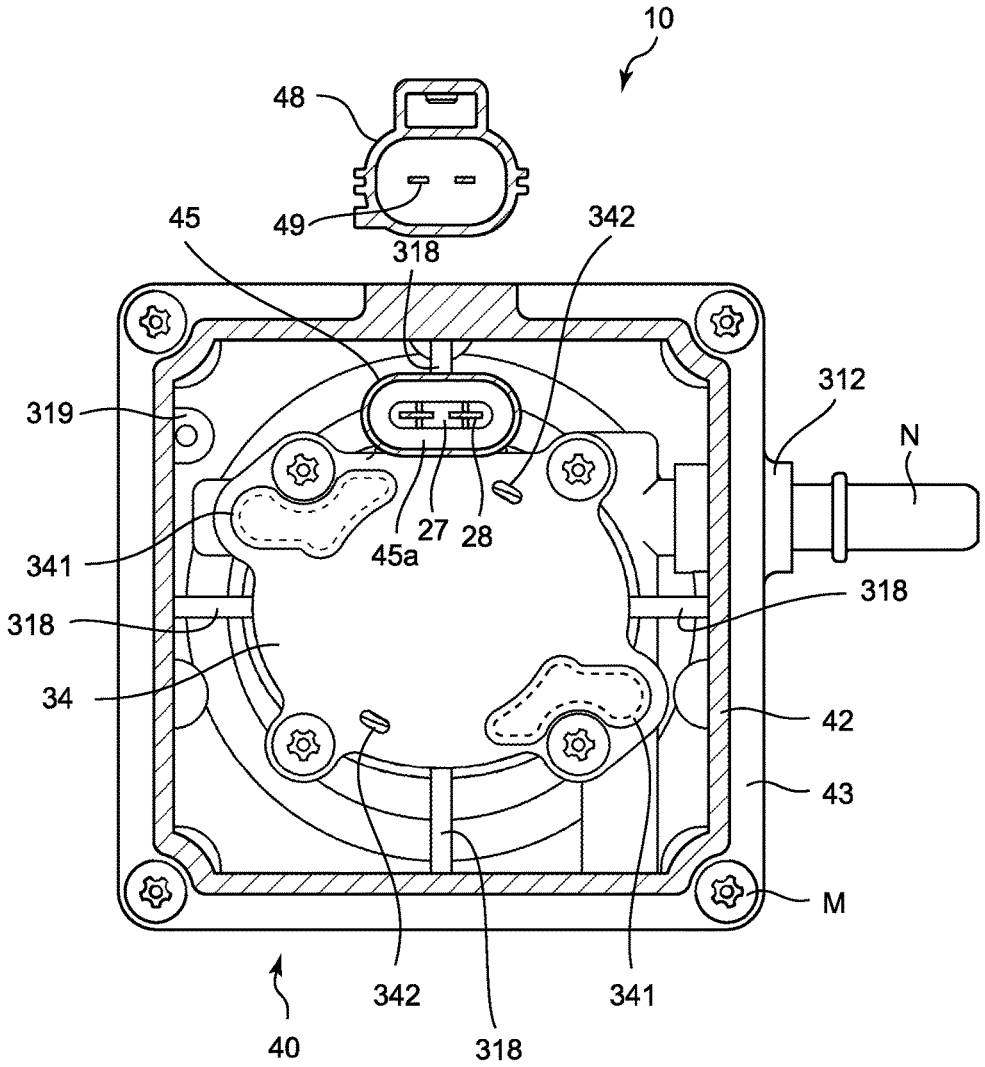
FIG. 9 is a cross sectional view illustrating a configuration of electric pump taken along line E-E of FIG. 6 when it is seen from the front surface side (cover side).

FIG. 4 is a cross sectional view illustrating a configuration of the electric pump 10 taken along line A-A of FIG. 3 when it is seen from the side surface side. FIG. 5 is a cross sectional view illustrating a configuration of the electric pump 10 taken along line B-B of FIG. 3 when it is seen from the side surface side. FIG. 6 is a side view of the electric pump 10. FIG. 7 is a cross sectional view illustrating a configuration of the electric pump 10 taken along line C-C of FIG. 6 when it is seen from the front surface side (at the side of the cover 40). FIG. 8 is a cross sectional view illustrating a configuration of the electric pump 10 taken along line D-D of FIG. 6 when it is seen from the front surface side (at the side of the cover 40). FIG. 9 is a cross sectional view illustrating a configuration of the electric pump 10 taken along line E-E of FIG. 6 when it is seen from the front surface side (at the side of the cover 40).

As shown in FIGS. 1, 4, and 5, the motor unit 20 includes an end cap 22, a rotation shaft 23, bearings 24, and magnets 25, which are covered by a motor cover 21.

The rotation shaft 23 is rotatably supported at one end by the bearing 24 (24*a*) attached to a bottom surface side (one end side) of the motor cover 21 and also rotatably supported by the bearing 24 (24*b*) attached to the end cap 22.

As shown in FIG. 4, a portion of the rotation shaft 23 extending to the outer side from the end cap 22 is provided with a spline shaft unit 23*a* and a centering portion 23*b*. The spline shaft unit 23*a* is a portion of the protruding portion of the rotation shaft 23 which is located at the side of the end cap 22. The centering portion 23*b* is a portion of the rotation shaft 23 located away from the end cap 22 (portion at the tip side of the rotation shaft 23).

As shown in FIG. 7, the spline shaft unit 23*a* is formed with multiple involute teeth 23*c*. More specifically, the spline shaft unit 23*a* is an involute spline shaft, and a hole (insertion hole 321) corresponding to the involute teeth 23*c* is provided at the center of a rotor 32 to be described later. In the present embodiment, the spline shaft unit 23*a* is formed with six involute teeth 23*c*.

As shown in FIG. 8, the centering portion 23*b* is a shaft portion of which cross section is a circular shape, and has a diameter corresponding to the centering hole 321*b*. More specifically, the centering portion 23*b* has such diameter that there is not chattering when it is fit into the centering hole 321*b* in order to maintain centering between the rotation shaft 23 and the rotor 32.

As shown in FIGS. 4, 7, and 8, the diameter of the spline shaft unit 23*a* to the apex of the involute tooth 23*c* (external diameter) is configured to be larger than the diameter of the centering portion 23*b*. The distance from a tooth bottom portion 23*d* between adjacent involute teeth 23*c* to a central axial line L of the rotation shaft 23 is equal to the radius of the centering portion 23*b*, or is larger than the radius of the centering portion 23*b*.

As shown in FIGS. 1, 4, and 5, the end cap 22 is attached to the side of the vane pump unit 30 which is an opening side of the motor cover 21, but a center hole 221 into which the rotation shaft 23 is inserted is provided at the center side of the end cap 22 (see FIG. 4). Further, a circumferential flange unit 222 protruding in a circumferential shape is provided at the center side of the end cap 22, and the bearing 24*b* explained above is fit into the fitting unit 223 encircled by the circumferential flange unit 222.

In this case, not the entire bearing 24*b* fit into the fitting unit 223 is not accommodated in the fitting unit 223, and a portion of the bearing 24*b* (about half in FIG. 4) is disposed to protrude from the fitting unit 223. The portion of the bearing 24*b* protruding from the fitting unit 223 is engaged with a bearing engagement unit 315*a* explained later.

As shown in FIG. 4, a rotator 231 is attached to the rotation shaft 23, and a wire is wound around this rotator 231. On the inner wall of the motor cover 21, magnets 25 are provided to face the rotator 231. Further, a commutator 232 is attached to the rotation shaft 23 at the side closer to the vane pump unit 30 than the rotator 231, and the commutator 232 is disposed to be in contact with a brush 26.

The brush 26 providing electric power to the commutator 232 is supported by a brush support unit 233 supported by the end cap 22 explained above. Therefore, even when the commutator 232 rotates with respect to the brush 26 according to the rotation of the rotation shaft 23, the brush 26 does not follow the rotation shaft 23 and provides electric power to the commutator 232. The brush support unit 233 is integrally formed with the end cap 22. In the conventional configuration, the brush 26 is supported by a brush plate separate from the end cap 22, but in the present embodiment, a configuration is employed in which the brush support unit 233 having the function of the brush plate is integrally configured with the end cap 22. In the present embodiment, the end cap 22 integrally formed with the brush support unit 233 is formed by, for example, resin molding.

As shown in FIGS. 1, 2, and 4, the end cap 22 is integrally formed with a power supply bus bar 27. The power supply bus bar 27 is an elongated portion protruding from the end cap 22 toward the vane pump unit 30 side, and the cross section thereof taken in a direction perpendicular to the protruding direction is a flat shape made by connecting a pair of arcs of semicircles and a pair of straight lines. In the power supply bus bar 27, a lead line 28 (corresponding to wire) is present, and a portion of the lead line 28 protrudes from the end of the power supply bus bar 27. For example, when the end cap 22 having the power supply bus bar 27 is resin-molded, the lead line 28 is formed in such a manner that it is embedded in the power supply bus bar 27 by methods such as insert molding and the like, for example. Therefore, the lead line 28 electrically connecting the brush 26 and a connection unit 46 can be disposed over the entire long power supply bus bar 27. However, an insertion hole may be provided along the longitudinal direction of the power supply bus bar 27, and the lead line 28 may be inserted into the insertion hole. It should be noted that the connection unit 46 will be explained later.

As shown in FIGS. 1, 2, 4, and 5, the end cap 22 of the motor unit 20 is attached to the pump plate 31, a component of the vane pump unit 30, via an O ring S1. The vane pump unit 30 includes not only the pump plate 31 but also the rotor 32, the vane 33, a seal S2, and the like, which will be explained later in order. In the present embodiment, the vane pump unit 30 is a portion functioning as a dry-type and vane-type vacuum pump not using any lubricating oil. The vane pump unit 30 corresponds to the pump unit.

(Integrate Configuration of Pump Plate 31)

Subsequently, the configuration of the pump plate 31 will be explained in details. As shown in FIGS. 1, 7, and 8, the pump plate 31 is a cam ring integrated-type plate in which each unit (for example, a cam bottom surface 313*b*, a bottom lid portion 319, connection units 319, and the like, explained later) including an external wall portion 311 and a cam ring 313 are integrally formed. Moreover, the pump plate 31 is made of, for example, an aluminum-based member which is a material having a high degree of thermal conductivity, but may be made of other materials (for example, a steel-based member). Examples of aluminum-based material that can be used include publicly known aluminum alloys such as Al—Si-based, Al—Si—Cu-based, Al—Fe—Cu-based, Al—Si—Mg-based, and Al—Si—Fe—Cu-based alloys, and an Al—SiC composite material obtained by adding SiC powder to the aluminum or aluminum alloy (a typical example is a material made by mixing SiC into Al—Si—Mg-based aluminum alloy).

As shown in FIGS. 1, 7, and 8, the entire internal configuration of the pump plate 31 is covered by the external wall portion 311 which has a substantially rectangular external appearance when seen in the top view, but this external wall portion 311 is provided with a nipple connection port unit 312 connected with a nipple N. The nipple connection port unit 312 is in communication with one end side of an intake path P (see FIG. 5) provided in the pump plate 31. The other end of the intake path P is exposed in an intake chamber C2 explained later, and a gas can be introduced into the intake chamber C2.

At the central side of the pump plate 31, the cam ring 313 enclosed by the external wall portion 311 is provided. The cam ring 313 is a ring-shaped portion projecting from a bottom lid portion 318 (explained later) of the pump plate 31 toward the cover 40 side, and the inner wall surface of the cam ring 313 is a cam surface 313*a*. A cam bottom surface 313*b* is provided at the bottom surface side in the inner space enclosed by the cam ring 313, so that the bottom surface side of the rotor 32 can be received. Further, the closing plate 34 (explained later) is attached to the side of the cover 40 of the cam ring 313. A rotor chamber C1 which is a space closed by the cam surface 313*a*, the cam bottom surface 313*b* (see FIGS. 1, 4 and 5, and the like) and the closing plate 34 is formed.

As shown in FIGS. 7 and 8, the cam surface 313*a* is provided in an oval shape, and the length in the minor axis side of the oval shape corresponds to the diameter of the rotor 32 which is a circular shape in the top view. Therefore, when the rotor 32 is arranged in the rotor chamber C1, two crescent shaped spaces (hereinafter referred to as intake chambers C2) with the short axis being the border is formed in the rotor chamber C1. The intake chambers C2 are in communication with the intake path P explained above, so that a gas can be introduced into this intake chamber C2.

Since the electric pump 10 according to the present embodiment is dry-type not using any lubricating oil, the cam surface 313*a* is formed with a coating film for improving the sliding property. As long as the sliding property can be improved, the composition and the deposition method of the coating film are not particularly limited, but it is preferable to employ a publicly-known hard plating film. The hard plating film in this case means a plating film provided with a higher degree of hardness than the cam ring 313 except the hard plating film. The hardness of the hard plating film where the temperature of the cam ring 313 rises may be higher than the vane 33.

Examples of such hard plating films include Ni—P—X-based plating films shown in, e.g., JP 2001-192850 A (X is at least a type of metal selected from the group consisting of W, Co, Pd, Re, Y, Mo, Ti, Mn, V, Zr, Cr, Cu, Au, Ag, Zn, Fe, Pb, Su, and Pt. This is also applicable to the following cases), and Ni—B—X-based plating films, Co—W-based plating film shown in, e.g., JP 4-94489 A, and a Ni—Co—P—W-based plating films shown in, e.g., JP 4185523 B1.

The improvement of the sliding property of the cam surface 313*a* can also be attained by changing the material of the pump plate 31. Examples of such materials that can be used for improving the sliding property of the cam surface 313*a* include Al—SiC composite materials explained above (a typical example is a material made by mixing SiC into Al—Si—Mg-based aluminum alloy). In the pump plate 31, at least the material in the portion of the cam ring 313 may be changed.

As shown in FIGS. 2 and 4, a protruding portion 314 protrudes from the side of the motor unit 20 with respect to the cam bottom surface 313*b* of the cam ring 313 toward the motor unit 20 side in such a manner that it is integrated with the cam ring 313. As shown in FIG. 2, in the present embodiment, the protruding portion 314 protrudes so that the external peripheral surface becomes a part of at least a portion of the circular peripheral surface. A recessed engagement unit 315 recessed from the motor unit 20 toward the cover 40 is provided at the end surface side of the protruding portion 314. In the present embodiment, the recessed engagement unit 315 is a stepped recessed portion, and a portion thereof at the side of the cover 40 having a small diameter is a bearing engagement unit 315*a*, and a portion thereof at the side of the motor unit 20 having a large diameter provided opposite to the bearing engagement unit 315*a* is a flange engagement unit 315*b*.

As shown in FIG. 4, the bearing engagement unit 315*a* is a recessed portion provided to have a smaller diameter than the flange engagement unit 315*b*. The bearing engagement unit 315*a* is a portion into which a portion of the bearing 24*b* explained above is fit and which supports the bearing 24*b*. More specifically, as explained above, a portion of the bearing 24*b* (about half in FIG. 4) is provided to protrude from the fitting unit 223. The protruding portion of the bearing 24*b* is fit into the bearing engagement unit 315*a*. For this reason, the bearing engagement unit 315*a* has a diameter corresponding to the bearing 24*b*. More specifically, the bearing 24*b* is configured to have approximately such a diameter so that it is prevented from moving in the radial direction (diameter direction) with respect to the bearing engagement unit 315*a* (hardly any chattering) when the bearing 24*b* is fit into the bearing engagement unit 315*a*. Alternatively, the bearing 24*b* may be fit into the bearing engagement unit 315*a* by shrink fit, for example.

The flange engagement unit 315*b* is a portion into which the circumferential flange unit 222 is fit, and has a larger diameter than the bearing engagement unit 315*a*. Therefore, since the circumferential flange unit 222 is fit into the flange engagement unit 315*b*, the inner diameter (the diameter at the inner peripheral side) of the flange engagement unit 315*b* corresponds to the external diameter (the diameter at the external peripheral side) of the circumferential flange unit 222. The circumferential flange unit 222 is configured to have approximately such a diameter that it is prevented from moving in the radial direction (diameter direction) with respect to the flange engagement unit 315*b* (hardly any chattering) when the circumferential flange unit 222 is fit into the flange engagement unit 315*b*. Alternatively, the circumferential flange unit 222 may be configured to have approximately such a diameter that it slightly moves with respect to the flange engagement unit 315*b*.

As shown in FIGS. 1, 7, and 8, the pump plate 31 is provided with a bulged portion 313*c* which is made by causing a portion of the cam ring 313 to bulge toward the external diameter side, and this bulged portion 313*c* is provided with a penetration hole 313*d*. The penetration hole 313*d* is a hole portion through which the power supply bus bar 27 is inserted, and is configured to be in a hole shape slightly larger than the power supply bus bar 27. More specifically, even when the power supply bus bar 27 is inserted into the penetration hole 313*d*, there is a slight gap between the power supply bus bar 27 and the inner wall surface of the penetration hole 313*d*. A discharge pipe 316 is integrally formed in proximity to the inner peripheral side of the external wall portion 311 of the pump plate 31. The discharge pipe 316 is a portion for discharging a gas discharged to the inside of the cover 40 from communication holes 342 (explained later). As shown in FIGS. 2 and 5, the pump plate 31 is provided with a protruding pipe 317 in communication with the discharge pipe 316 to protrude to the side of the motor unit 20.

In this case, as shown in FIGS. 1, 5, 7, and 8, the bottom lid portion 318 is provided between the external wall portion 311 and the cam ring 313, and the connection units 319 are provided vertically from the bottom lid portion 318. The bottom lid portion 318 is provided between the external wall portion 311 and the cam ring 313 to shut off communication between the motor unit 20 side and the cover 40 side. This bottom lid portion 318 is integrally made with the external wall portion 311 and the cam ring 313.

In this case, the term "integrally" means that elements are formed as a single member through, e.g., casting process such as die cast, injection molding, and the like, and no interface exists unlike a case where separate bodies are fixed later using screws and the like or by means of adhering. However, when two separate members are fixed by welding, there is no interface separating the two members, so that atoms or molecules of the two members are dispersed from each other. Therefore, "welding" is included in the concept of "integrally" referred to herein. It should be noted that the concept of "integrally" is also applicable to a connection unit 319 explained below.

It should be noted that the bottom lid portion 318 need not be in a plate shape, and the bottom lid portion 318 may be configured to extend toward at least one of the motor unit 20 side and the cover 40 side, and have unevenness, a penetration hole, and the like as necessary.

The connection unit 319 is a portion vertically provided from the bottom lid portion 318 toward the cover 40 side. This connection unit 319 is provided such that its external appearance is in, for example, a rib shape (protrusion shape). Like the bottom lid portion 318 explained above, the connection unit 319 is integrally formed with the external wall portion 311 and the cam ring 313. This connection unit 319 protrudes to have a certain height from the bottom lid portion 318. More specifically, the connection unit 319 protrudes from the bottom lid portion 318 so that the end surface of the protruding side of the connection unit 319 is located at a side closer to the end surface of the cam ring 313 than the bottom lid portion 318. The end surface at the protruding side of the connection unit 319 may protrude to have about the same height as the end surface of the cam ring 313, but as shown in FIG. 1, the end surface at the protruding side of the connection unit 319 may protrude to such a level that it is slightly lower than the end surface of the cam ring 313.

In this case, the connection unit 319 is preferably provided along the shortest path between the external wall portion 311 and the cam ring 313. This is because when the connection unit 319 is provided along the shortest path as described above, this can improve the cooling performance of the cam ring 313 by preferably transmitting the heat generated by the cam ring 313 to the external wall portion 311 when the temperature gradient of the connection unit 319 is taken into consideration.

Each of the connection units 319 is provided with a predetermined angle in the peripheral direction of the cam ring 313. In the configuration as shown in FIG. 7, the connection units 319 are provided on every 90 degrees. However, the connection units 319 are not limited to such configuration provided on every 90 degrees, and a configuration for disposing the connection units 319 on any angle may be employed. An example of such angle may be appropriately selected from, e.g., those obtained by dividing 360 degrees by N (N is an integer).

A configuration for providing the connection units 319 on every predetermined angle may not be employed. Instead, the angle between multiple connection units 319 in the peripheral direction may be irregular.

In the configuration as shown in FIGS. 7 to 9, when the pump plate 31 is seen in the top view, the central line of at least one of multiple connection units 319 passes through a closest portion where the cam surface 313*a* is closest to the rotor 32, and further passes the center of the cam ring 313. More specifically, the connection units 319 are arranged in a radial manner from the center of the cam ring 313 (the rotation center of the rotor 32). Accordingly, the connection units 319 are in a state of easily coming along the shortest path between the external wall portion 311 and the cam ring 313 as described above. However, a line passing through the center of the cam ring 313 (the rotation center of the rotor 32) may be configured to be slightly away from the central line of the connection unit 319.

In the rotation direction of the rotor 32, the connection unit 319 is preferably arranged to connect the external wall portion 311 and the cam ring 313 and in proximity to the side where the volume of a pressure chamber C3 explained later is reduced (the end side of the intake chamber C2 in the rotation direction of the rotor 32). In particular, when the gas is compressed according to the rotation of the rotor 32, the temperature increases. Therefore, when the connection unit 319 is disposed in proximity to the side where the volume of the pressure chamber C3 is reduced, which is a side where the temperature is higher, then, the cooling performance of the cam ring 313 can be increased.

In the configuration as shown in FIGS. 7 to 9, a line connecting between the closest portion where the rotor 32 is closest to the cam surface 313*a* of the cam ring 313 and the center of the cam ring 313 (the rotation center of the rotor 32) is configured to pass through the central line of some of the connection units 319. Therefore, some of the connection units 319 improve the cooling performance of the cam ring 313. In this case, some of the connection units 319 explained above correspond to totally two connection units 319 existing at the upper side and the lower side of FIGS. 7 to 9.

(Rotor 32)

As shown in FIGS. 1, 2, and the like, the external appearance of the rotor 32 is made in a substantially in a cylindrical shape, but at the center side of the rotor 32, the insertion hole 321 is provided. As shown in FIG. 4, the insertion hole 321 is made in a stepped hole shape, and the insertion hole 321 at the side of the motor unit 20 is referred to as a spline hole 321*a*, and the insertion hole 321 at the side of the cover 40 opposite to the spline hole 321*a* is referred to as a centering hole 321*b*. As shown in FIG. 7, the spline hole 321*a* is a hole portion corresponding to engagement with the spline shaft unit 23*a* explained above. The spline hole 321*a* is provided such that a female tooth portion 321*a*1 with which the involute teeth 23*c* of the spline shaft unit 23*a* come into abutment protrudes to the center side. The spline shaft unit 23*a* engages with the spline hole 321*a* while the involute teeth 23*c* come into abutment with the female tooth portion 321*a*1, so that a rotation torque (rotation force) of the rotation shaft 23 is transmitted to the rotor 32.

The spline hole 321*a* has such a gap with the spline shaft unit 23*a* to allow for some chattering to such a degree that the spline shaft unit 23*a* can slightly move in the radial direction (diameter direction).

As shown in FIGS. 4 and 8, the centering hole 321*b* is a portion into which the centering portion 23*b* of the rotation shaft 23 is fit. With this fitting, the rotation shaft 23 is centered with respect to the rotor 32. The centering hole 321*b* has a diameter corresponding to the centering portion 23*b*. More specifically, when the centering hole 321*b* is fit into the centering portion 23*b*, the centering portion 23*b* is made to have such a diameter that the centering portion 23*b* is allowed to rotate with respect to the centering hole 321*b*, but is prevented from moving in the radial direction (diameter direction) (there is hardly any chattering). Therefore, as shown in FIGS. 4 and 8, while the centering portion 23*b* of the rotation shaft 23 is inserted into the centering hole 321*b* of the insertion hole 321 of the rotor 32, the rotation center of the rotation shaft 23 and the rotation center of the rotor 32 match each other with a high degree of accuracy.

As shown in FIGS. 7 and 8, the external peripheral surface of the rotor 32 is provided with multiple vane grooves 322, and the vane 33 is movably accommodated in the vane groove 322. The vane groove 322 is provided in parallel to the central axial line L of the rotor 32 (see FIGS. 1, 2, and 4), and the vane groove 322 is not along the diameter direction of the rotor 32, and is formed in a direction such that a direction from the central side to the external peripheral side matches the direction of advancement of rotation. The vane 33 is disposed in the vane groove 322 explained above, and the vane 33 comes into abutment with the cam surface 313*a* due to the centrifugal force of the rotation of the rotor 32, so that the pressure chamber C3 is formed in the intake chamber C2. The pressure chamber C3 is a portion of the intake chamber C2 which is partitioned by a vane 33 and the rotor 32, or a portion thereof partitioned by adjacent vanes 33.

As shown in FIGS. 1 and 9, the closing plate 34 is attached to the end surface of the cam ring 313 at the side of the cover 40 using screws and the like, for example, and the rotor chamber C1, which is a closed space, is formed by the attachment of the closing plate 34. As shown in FIG. 9, a projection unit 341 projecting toward the cover 40 side by plastic deformation of the closing plate 34 made through press work is formed on the closing plate 34. The projection unit 341 at the side of the motor unit 20 is a portion of the intake path P (see FIG. 5). The projection unit 341 at the side of the rotation center is an opening portion in communication with the rotor chamber C1. A portion of an insertion hole P1 constituting the intake path P is formed in the cam ring 313 explained above, and the insertion hole P1 is in communication with the projection unit 341 at the side away from the rotation center. The insertion hole P1 is in communication with the nipple N explained above.

As shown in FIG. 9, the closing plate 34 is provided with the communication holes 342. The communication holes 342 are in communication with the intake chambers C2. The opening portion of the projection unit 341 is in communication with one end side of the intake chamber C2 in a crescent shape as shown in FIGS. 7 and 8, and the communication hole 342 is in communication with the other end side of the intake chamber C2 in the crescent shape. When seen in the rotation direction of the rotor 32, the external peripheral surface of the rotor 32 passes in proximity to the opening portion of the projection unit 341, and advances along the intake chamber C2 for some distance, and thereafter, comes to the vicinity of the communication hole 342.

As shown in FIGS. 1 and 2, the cover 40 is attached to the pump plate 31 with a seal S2 interposed therebetween. The cover 40 is a member for covering and closing the pump plate 31 opposite to the motor unit 20 side. This cover 40 is provided with a top surface portion 41 and a side surface portion 42, and the top surface portion 41 faces the pump plate 31 with a predetermined gap therebetween. A flange unit 43 is provided on the side surface portion 42 at the side of the vane pump unit 30, and the flange unit 43 is in contact with the end surface of the external wall portion 311, and is fixed to the external wall portion 311 with screws M. As shown in FIG. 5, multiple ribs 44 are provided to protrude from the top surface portion 41 toward the pump plate 31, and these ribs 44 are disposed along the vertical direction and the horizontal direction perpendicular to the central axial line L (see FIG. 1, FIG. 2, and the like). More specifically, the ribs 44 are disposed in a lattice manner on the top surface portion 41.

As shown in FIGS. 4 and 5, when the cover 40 is attached to the pump plate 31, an expansion space C4 is provided inside the cover 40. More specifically, the main portion of the expansion space C4 is between the closing plate 34 and a resonator plate 50, and in addition, the space between the external wall portion 311, the cam ring 313, and the bottom lid portion 318 is also a part of the expansion space C4. This expansion space C4 is a portion into which the gas discharged from the intake chamber C2 flows via the communication hole 342, and at this occasion, the gas compressed in the intake chamber C2 expands when the gas enters the expansion space C4.

In this case, in the present embodiment, as shown in FIG. 4, the end surface of the pump plate 31 at the side of the cover 40 is provided to be in abutment with the end surface of the flange unit 43, and the pump plate 31 does not enter the inside of the cover 40. In addition, the pump plate 31 has such structure that the external wall portion 311, the cam ring 313, the bottom lid portion 318, the intake path P, and the like are integrated. Therefore, the size of the vane pump unit 30 in the direction along the central axial line L is reduced. Accordingly, if the size of the electric pump 10 along the central axial line L is the same, the cover 40 according to the present embodiment can be made so that the expansion space C4 has a larger size in the direction along the central axial line L, and this increases the volume of the expansion space C4. Therefore, this achieves a configuration for more greatly reducing the noise than the conventional technique.

Figure 10:
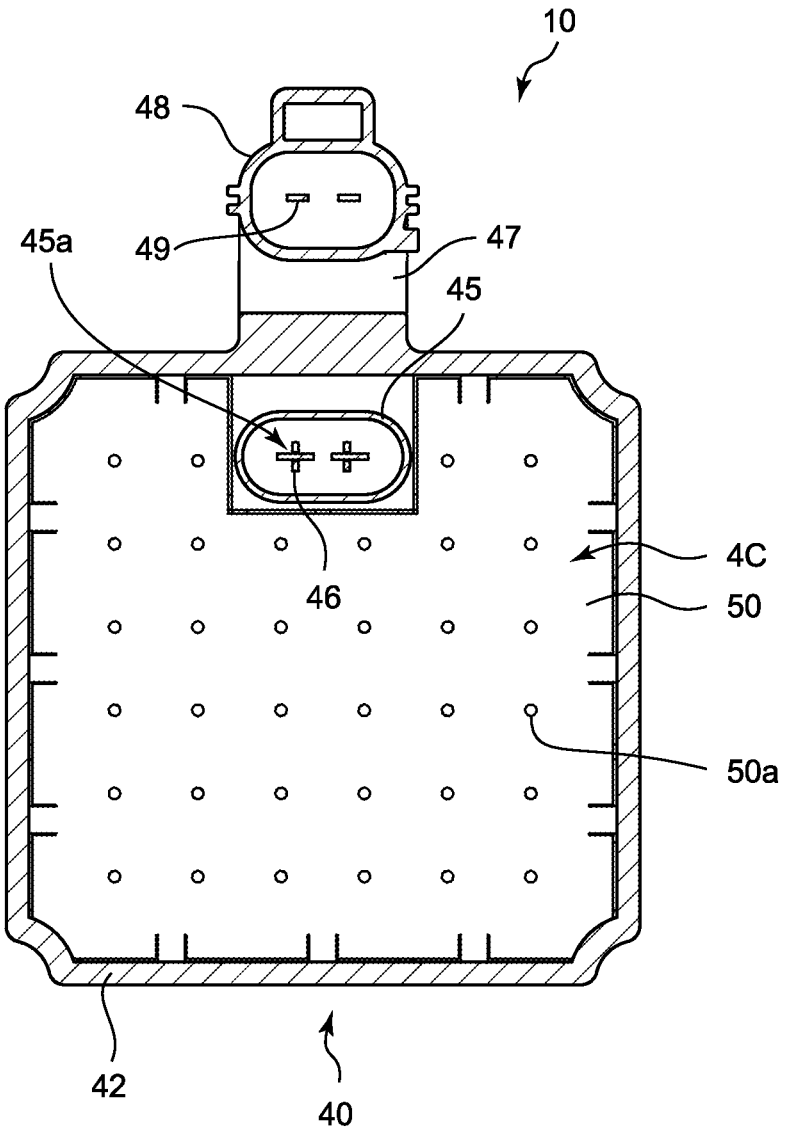
FIG. 10 is a cross sectional view illustrating a configuration of electric pump taken along line F-F of FIG. 6 when it is seen from the back surface side (motor unit side).

FIG. 10 is a cross sectional view illustrating a configuration of the electric pump 10 taken along line F-F of FIG. 6 when it is seen from the back surface side (the side of the motor unit 20). As shown in FIG. 5, the end surface of the ribs 44 at the side of the vane pump unit 30 is a receiving surface for the resonator plate 50 as shown in FIGS. 2 and 10, and the resonator plate 50 is arranged on the receiving surface. Accordingly, small chambers C5 (see FIG. 5) enclosed by the top surface portion 41, the rib 44, and the resonator plate 50 are formed.

The resonator plate 50 is made of a material such as steel-based material having a higher density than the resin material which is the material of the cover 40, and the resonator plate 50 is less likely to vibrate because of its weight. Therefore, when a sound wave collides with the resonator plate 50, the resonator plate 50 can also achieve the effect of reducing the noise. However, the resonator plate 50 may also be made of a material other than steel-based material. Examples of such materials include aluminum-based member, resin-based material, and the like.

As shown in FIG. 10, the resonator plate 50 is formed with multiple holes 50*a* respectively in communication with the small chambers C5. The gas can enter there and exit therefrom through the hole 50*a*, and the small chamber C5 functions as a resonator using sound resonance effect.

As shown in FIGS. 2, 4, 9, and 10, a connector box 45 is provided on the cover 40 in a protruding manner from the top surface portion 41 thereof toward the pump plate 31 side, and an insertion recessed portion 45*a* in a recessed shape is formed by being enclosed by the connector box 45. The power supply bus bar 27 explained above can be inserted into the insertion recessed portion 45*a* (see FIG. 4). The connection unit 46 electrically connected to the lead line 28 is provided in the insertion recessed portion 45*a* at the side of the top surface portion 41, and when the power supply bus bar 27 is inserted into the insertion recessed portion 45*a*, the lead line 28 is electrically connected to the connection unit 46 (see FIG. 4).

The insertion recessed portion 45*a* is provided in such a manner as to be positioned with the penetration hole 313*d* existing in the bulged portion 313*c*. A grommet 51 shown in FIGS. 1, 2, and 4 is disposed at the side of the opening of the connector box 45, and this grommet 51 is also in contact with the end surface of the bulged portion 313*c*. As shown in FIG. 4, the grommet 51 gets into the insertion recessed portion 45*a* by a predetermined amount, and the power supply bus bar 27 is inserted into the insertion recessed portion 45*a* via the grommet 51, and the lead line 28 is electrically connected to the connection unit 46 when inserted.

As shown in FIGS. 3, 4, 6, 10, and the like, the side surface portion 42 located in proximity to the connector box 45 is provided with an extension unit 47 extending in a direction away from the central axial line L, and a connector cover 48 extends from the extension unit 47 to return back to the motor unit 20 side in parallel with the central axial line L.

It should be noted that the connector cover 48 is made in a cylindrical shape of which end portion at the side of the motor unit 20 is open, and a cable, not shown, can be inserted into this connector cover 48. The connector cover 48 can be formed in various shapes according to the connector shape of the vehicle to which the electric pump 10 according to the present embodiment is attached.

Inside of the extension unit 47, a connector bus bar 49 one end side of which is electrically connected to the connection unit 46 is provided (see FIG. 4, FIG. 10), the other end side of the connector bus bar 49 protrudes into the inside of the space of the connector cover 48, so that the connector bus bar 49 can be electrically connected to the inserted cable. The connector bus bar 49 corresponds to a conductive member.

<2. Operation of Electric Pump 10>

In the electric pump 10 having the above configuration, electric power is provided from the cable via the connector bus bar 49, the connection unit 46, the lead line 28, the brush 26, and the commutator 232 to the wound wire of the rotator 231, and by providing the electric power, the rotator 231 and the rotation shaft 23 are rotated.

In the rotation of the rotation shaft 23, the spline shaft unit 23*a* engages with the spline hole 321*a*, so that the rotation torque (rotation force) of the rotation shaft 23 is transmitted to the rotor 32. At this occasion, as shown in FIG. 4, the centering portion 23*b* of the rotation shaft 23 is inserted into the centering hole 321*b* of the insertion hole 321 of the rotor 32. Therefore, the rotation center of the rotation shaft 23 and the rotation center of the rotor 32 match each other with a high degree of accuracy, and the rotor 32 is prevented from moving with respect to the rotation shaft 23 in the radial direction (diameter direction).

By the way, according to the rotation of the rotation shaft 23, the rotor 32 rotates in the counterclockwise direction in FIGS. 7 and 8. According to the rotation of the rotor 32, centrifugal force is exerted on the vane 33 in a direction away from the vane groove 322. Accordingly, the vane 33 comes into contact with the cam surface 313*a*. In this case, the cam surface 313*a* of the cam ring 313 is provided with the coating film explained above, or at least the cam ring 313 of the pump plate 31 is made of an Al—SiC composite material made by adding SiC powder to aluminum or aluminum alloy. Therefore, the vane 33 easily slides with respect to the cam surface 313*a*, which improves the sliding property.

When the vane 33 that is in contact with the cam surface 313*a* comes to the intake chamber C2, a pressure chamber C3 is formed between the vane 33 and one of the top clearances between the rotor 32 and the cam surfaces 313*a* (one of the closest portions) or between the vane 33 and an adjacent vane 33. The volume in the pressure chamber C3 increases for some time along the rotation direction of the rotor 32, and therefore, the gas such as air is sucked through the opening portion of the projection unit 341. However, when the vane 33 advances to the other of the top clearances between the rotor 32 and the cam surfaces 313*a* (the other of the closest portions) for some time, the volume of the pressure chamber C3 decreases in turn, so that the gas inside thereof is compressed. Accordingly, when the pressure chamber C3 becomes in communication with the communication hole 342, the gas such as air is discharged through the communication hole 342.

The temperature of the cam ring 313 greatly increases because of the sliding of the vane 33 to the cam surface 313*a* and the gas compression in the pressure chamber C3. In this case, the pump plate 31 is provided such that the entire pump plate 31 including the external wall portion 311 and the cam ring 313 are integrated. Accordingly, for example, as compared with a configuration in which the cam ring 313 and the like are separately provided, the heat radiation property of the cam ring 313 improves. In other words, the cooling performance of the cam ring 313 improves.

In addition, between the external wall portion 311 and the cam ring 313, the connection unit 319 is integrally provided. Therefore, this connection unit 319 functions as an active heat transmission path, and the heat of the cam ring 313 is easily dissipated to the outside. Not only the connection unit 319 but also the bottom lid portion 318 function as active heat transmission paths, and the heat of the cam ring 313 is also easily dissipated to the outside via the bottom lid portion 318. Since the heat of the cam ring 313 is easily dissipated to the outside, the amount of wear of the vane 33 is reduced as compared with a case where the temperature of the cam ring 313 is high.

Figure 11:
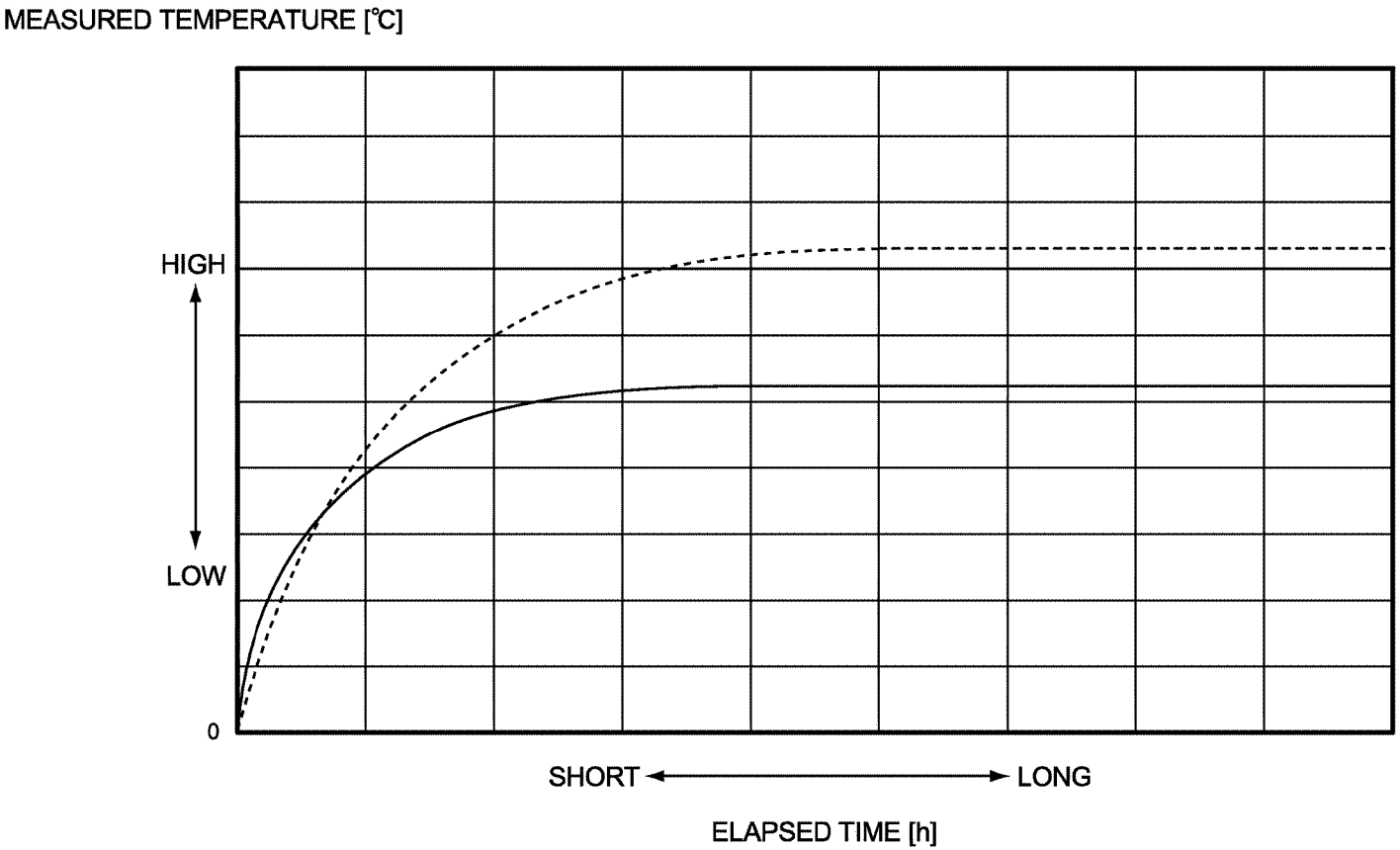
FIG. 11 is a figure illustrating a relationship between the operation time and the temperature of the pump plate when the electric pump is activated.

In this case, how the temperature of the pump plate 31 having the cam ring 313 decreases is shown in FIG. 11. FIG. 11 is a graph illustrating a relationship of the temperature of the pump plate 31 and the operation time when the electric pump 10 is activated. In FIG. 11, the vertical axis denotes the temperature of the pump plate 31, and the horizontal axis denotes the operation time of the electric pump 10.

In FIG. 11, a solid line denotes a case where the electric pump 10 according to the present embodiment is activated, and a broken line denotes a case where a conventional electric pump is activated. As is evident from FIG. 11, in the electric pump 10 according to the present embodiment, the temperature of the pump plate 31 becomes less than that of the pump plate of the conventional electric pump. In particular, in a stationary state in which the temperature does not increase, the temperature of the pump plate 31 of the present embodiment is suppressed to a lower level than the pump plate of the conventional electric pump.

Figure 12:
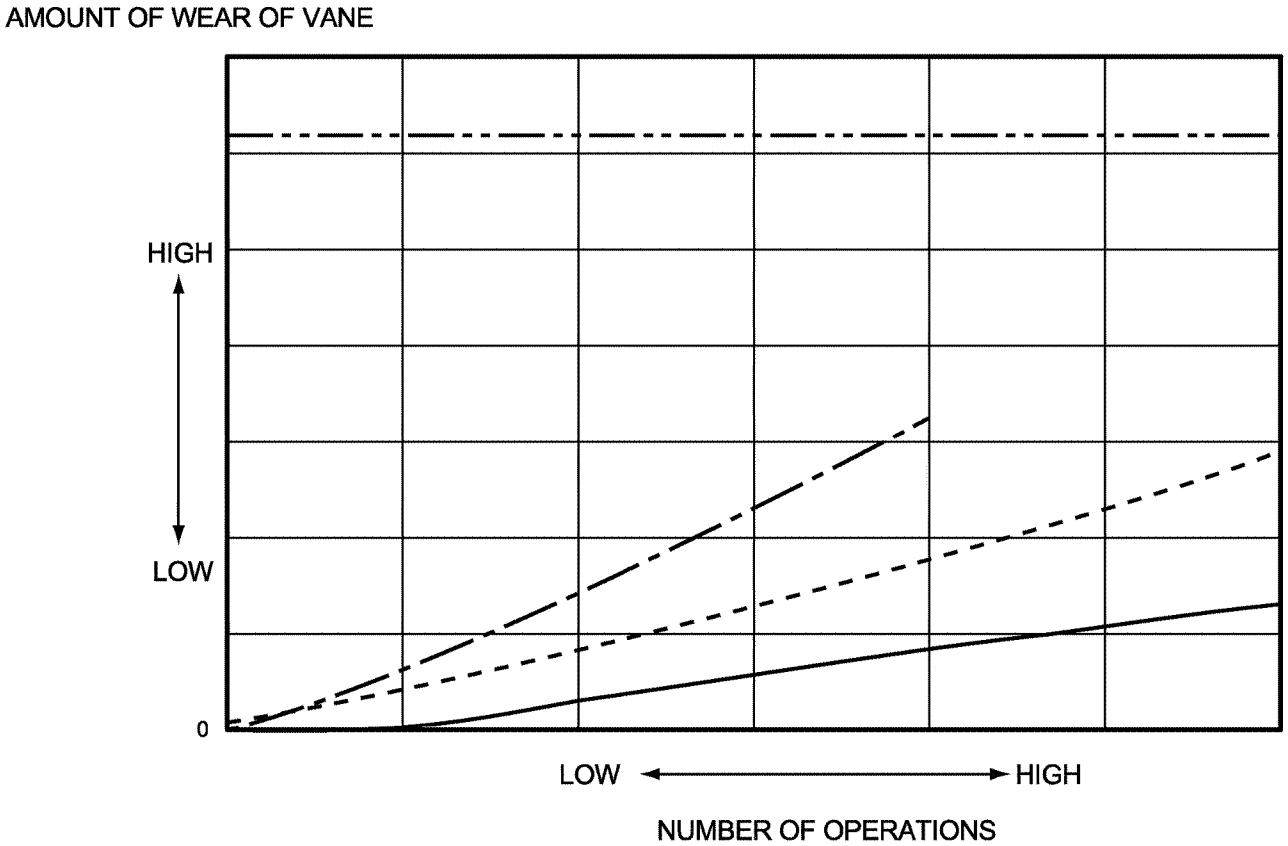
FIG. 12 is a figure illustrating a relationship between the amount of wear of a vane 33 and the number of times of operation when the electric pump is activated.

FIG. 12 shows the amount of wear of the vane 33 of the electric pump 10 according to the present embodiment and the amount of wear of the vane 33 of the conventional electric pump. In FIG. 12, the vertical axis denotes the amount of wear of the vane 33, and the horizontal axis denotes the number of times of operation of the electric pump 10. In FIG. 12, a solid line relates to a case where the activation pump 10 according to the present invention is activated, and shows a case where the pump plate 31 is made of Al—SiC composite material. A broken line indicates a case where a conventional electric pump using a cam ring made of SUS is activated. Further, an alternate long and short dashed line indicates one obtained by applying alumite treatment to the cam surface of the cam ring of which material is aluminum. An alternate long and two short dashes line denotes a limitation of wear of the vane 33.

As is evident from FIG. 12, in a case where the pump plate 31 of the electric pump 10 is made of Al—SiC composite material, the amount of wear of the vane 33 is reduced to a level less than that of the conventional electric pump using the cam ring made of SUS.

By the way, by compressing and sucking the gas according to the rotation of the rotor 32 as described above, the vane pump unit 30 generates a large operation sound (noise).

However, when the gas enters the cover 40 from the intake chamber C2 via the communication hole 342, the gas compressed in the intake chamber C2 expands when the gas enters the expansion space C4. As described above, when the gas expands in the expansion space C4, the speed and the pressure of the gas decrease, and further, the sound waves interfere with each other by interference made by reflection and the like of sound waves in the expansion space C4, and accordingly, the acoustic energy of the gas is attenuated. Therefore, the sound generated by the vane pump unit 30 is reduced.

In addition, the change in the pressure of the gas (sound waves) enters the inside of the expansion space C4 via the holes 50*a*. More specifically, this makes a vibration system so that, when a sound wave of a particular frequency enters the small chambers C5 through the hole 50*a*, the gas inside of the small chambers C5 acts as a spring, and the gas located inside of the hole 50*a* penetrating through the resonator plate 50 acts as a spindle.

In the vibration system explained above, a resonance occurs of which predetermined frequency is the characteristic frequency, but when the frequency of the sound wave (particular frequency) matches the characteristic frequency, the resonance occurs and the vibration increases, and the gas intensively enters and exists in proximity to the hole 50*a*. Because of this entering and exiting, for example, the acoustic energy of the gas is converted into frictional heat, so that it is reduced. Accordingly, the noise generated by the vane pump unit 30 is reduced.

Figure 13:
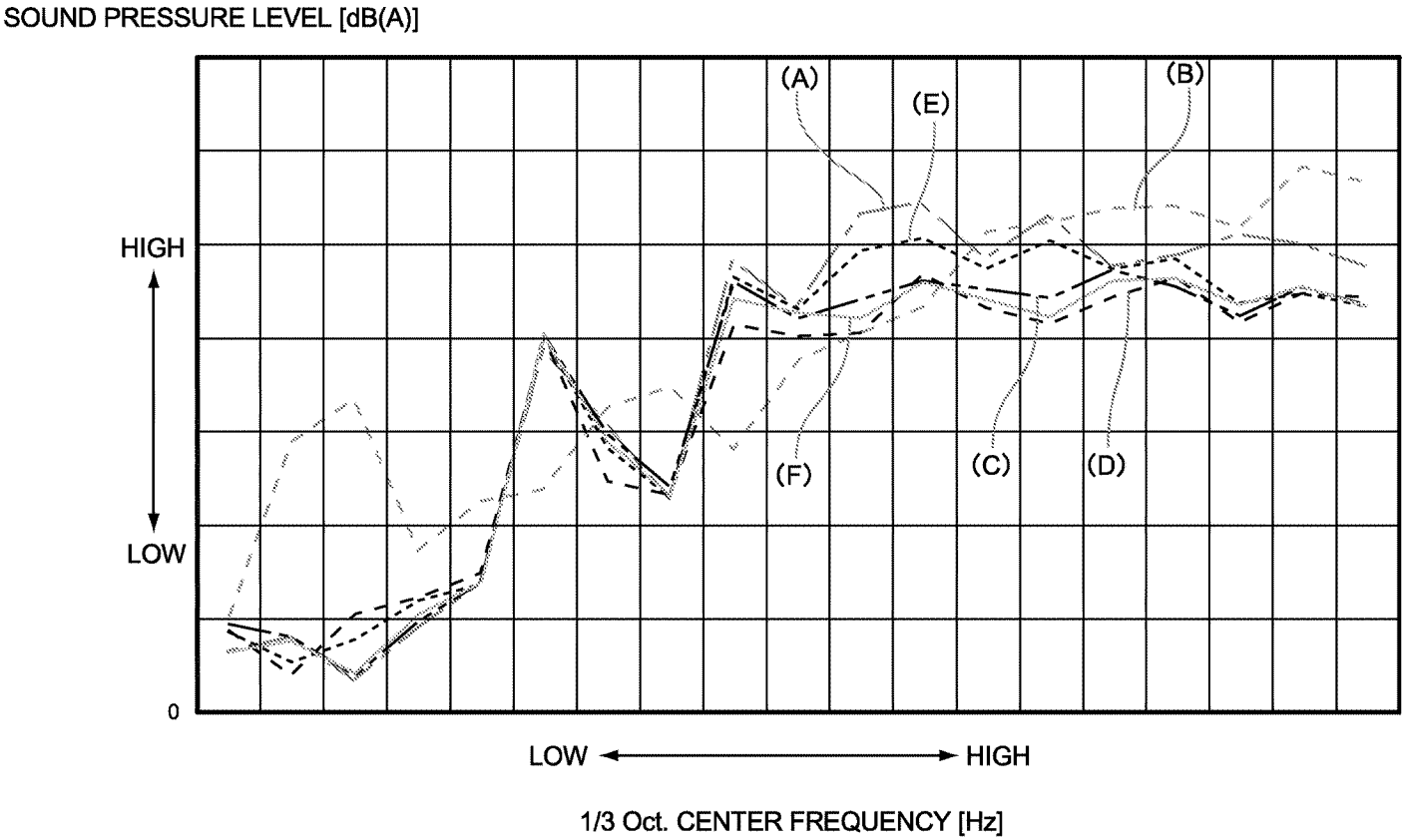
FIG. 13 is a figure illustrating a relationship between a sound pressure level and a frequency when a hole diameter and a plate thickness of a resonator plate are changed.

In this case, when the volume of the small chambers C5 is constant because of the height and the arrangement of the ribs 44, the effect of reducing the noise is different in accordance with the diameter of the hole 50*a* and the plate thickness of the resonator plate 50. This state is shown in FIG. 13. FIG. 13 is a graph illustrating a relationship between a center frequency (Hz) of ⅓ octave-band and a sound pressure level (dB).

In FIG. 13, a case where there is no resonator plate 50 is indicated by a sequential line (A) and a sequential line (B). A case where the plate thickness is 2 mm and the diameter of the hole 50*a* is 1.5 mm is indicated by a sequential line (C). A case where the plate thickness is 2 mm and the diameter of the hole 50*a* is 2 mm is indicated by a sequential line (D). A case where the plate thickness is 2 mm and the diameter of the hole 50*a* is 3 mm is indicated by a sequential line (E). A case where the plate thickness is 1.5 mm and the diameter of the hole 50*a* is 2 mm is indicated by a sequential line (F).

In the case shown in FIG. 13, the peak of the sound pressure level is the lowest and the noise reduction effect is the highest in the case of the sequential line (D).

After the noise is reduced as described above, the gas inside the expansion space C4 is discharged via the discharge pipe 316 to the outside.

<3. Effects>

According to the electric pump 10 having the above configuration, the pump plate 31 is provided with the external wall portion 311 and the cam ring 313 which are integrally formed. Therefore, for example, as compared with a case where the cam ring 313 and the like are provided separately, the cooling performance of the cam ring 313 can be improved. More specifically, the heat radiation efficiency during operation of the electric pump 10 can be improved.

In particular, between the external wall portion 311 and the cam ring 313, the connection unit 319 is integrally provided. Therefore, the connection unit 319 functions as an active heat transmission path, and the heat of the cam ring 313 can be easily dissipated to the outside. Further, not only the connection unit 319 but also the bottom lid portion 318 function as active heat transmission paths, and the heat of the cam ring 313 is also easily dissipated to the outside via the bottom lid portion 318.

In the present embodiment, it may also be possible to employ a configuration that the connection units 319 are provided on every predetermined angle along the peripheral direction of the cam ring 313. When such configuration is used rather than arranging the same number of connection units 319 with irregular angles along the peripheral direction of the cam ring 313, a portion having locally high temperature can be prevented from occurring on the cam ring 313, and the deviation of the heat radiation property can be reduced.

Further, in the present embodiment, the end surface of the connection units 319 at the protruding side from the bottom lid portion 318 may be disposed at a side closer to the end surface at the protruding side of the cam ring 313 than the bottom lid portion 318. In this case, the height of the connection units 319 from the bottom lid portion 318 is sufficiently ensured, and the connection units 319 can function as preferable heat transmission path. Therefore, the heat of the cam ring 313 can be easily dissipated to the outside via the connection units 319.

In the present embodiment, when the pump plate 31 is seen in the top view, a central line of at least one of multiple connection units 319 (two connection units 319 in FIGS. 7 to 9) may be configured to pass through the closest portion where the rotor 32 is closest to the cam surface 313*a*, and further may be configured to pass through the center of the cam ring 313. In this case, the connection unit 319 is likely to be along the shortest path between the external wall portion 311 and the cam ring 313, and the heat generated by the cam ring 313 is preferably transmitted to the external wall portion 311, so that the heat radiation property of the electric pump 10 can be improved.

Further, in the present embodiment, the pump plate 31 may be made of aluminum-based member. In this case, aluminum-based member has a high degree of thermal conductivity, and therefore, the heat of the cam ring 313 can be preferably dissipated to the outside. Accordingly, the heat radiation property of the electric pump 10 can be improved.

In the present embodiment, the cam surface 313*a* may be provided with the coating film in order to improve the sliding property of the vane 33, and this coating film can be a hard plating film of which hardness is less than the hardness of the cam ring 313 except the cam surface 313*a*. When such hard plating is used for the coating film, the vane 33 is likely to slide with respect to the cam surface 313*a*, and the sliding property can be improved.

Further, in the present embodiment, the hardness of the coating film formed on the cam surface 313*a* when the temperature of the cam ring 313 rises may be configured to be harder than the vane 33. When such coating film is used, the sliding property can be further enhanced. In addition, the anti-wear property of the cam surface 313*a* can be improved, and the lifetime of the electric pump 10 can be increased.

In the electric pump 10 according to the present embodiment, at least the cam ring 313 of the pump plate 31 can be made of an Al—SiC composite material made by adding SiC powder to aluminum or aluminum alloy. When such configuration is employed, the vane 33 easily slides with respect to the cam surface 313*a*, which improves the sliding property.

In the electric pump 10 according to the present embodiment, the expansion space C4 is formed in a portion inside of the cover 40 and between the cover 40 and the vane pump unit 30. Therefore, when the gas compressed in the intake chamber C2 enters the expansion space C4, the gas expands, and accordingly, the noise generated by the vane pump unit 30 is reduced.

In addition, in the present embodiment, as shown in FIG. 4, the pump plate 31 has such structure that the external wall portion 311, the cam ring 313, the intake path P, and the like are integrated, and the end surface of the pump plate 31 at the side of the cover 40 is disposed at the same position as the end surface of the flange unit 43, and therefore the pump plate 31 does not enter the inside of the cover 40. Therefore, the size of the vane pump unit 30 in the direction along the central axial line L is reduced. Accordingly, if the size of the electric pump 10 along the central axial line L is the same, the cover 40 according to the present embodiment can be made such that the size of the expansion space C4 in the direction along the central axial line L can be increased, so that the volume of the expansion space C4 can be increased. Therefore, the noise can be reduced more greatly than the conventional configuration.

In the present embodiment, multiple ribs 44 are provided on the cover 40 to protrude toward the vane pump unit 30 side. At the end side of the protrusion of the rib 44, the resonator plate 50 is arranged, and the small chambers C5 separated from the expansion space C4 are formed by the resonator plate 50, the ribs 44, and the inner wall of the cover 40. Therefore, the gas is flown into and out of the small chamber C5 via the hole 50*a*, and the resonance is caused, so that the acoustic energy of the gas can be changed into frictional heat and the like, and the acoustic energy can be reduced. Therefore, the noise generated by the vane pump unit 30 can be reduced.

Further, in the present embodiment, the ribs 44 are provided on the top surface portion 41 facing the vane pump unit 30 at the position of the cover 40 away from the vane pump unit 30, and the resonator plate 50 is attached to the top surface portion 41, so that the small chambers C5 are formed. Therefore, the small chambers C5 are formed at the side of the top surface portion 41 having the largest size of area, and therefore, more small chambers C5 can be provided than small chambers C5 provided at another portion of the cover 40. Accordingly, the noise reduction effect is further improved.

In the present embodiment, multiple ribs 44 are arranged in the lattice manner on the top surface portion 41. Therefore, many small chambers C5 can be formed. In addition, in a case where the ribs 44 are arranged regularly like a lattice, the characteristics of the noise reduction by each of the small chambers C5 can be the same, and the acoustic energy of a desired frequency can be reduced in a preferable manner. Since the ribs 44 are arranged in a lattice form on the top surface portion 41, the strength of the cover 40 at the side of the top surface portion 41 can be improved.

<Modification>

Each embodiment of the present invention has been hereinabove explained, but the present invention can be modified in various manners other than the above. This will be hereinafter explained.

In the above embodiments, no member is disposed in the small chambers C5. However, for example, a material having sound adsorption effect such as glass wool may be arranged in the small chambers C5. In such configuration, the acoustic energy can be further reduced in a preferable manner.

According to the above embodiment, in the small chambers C5, the acoustic energy of the gas is changed into frictional heat and the like by the resonance of the gas, so that the noise is reduced. However, the phase of the sound reflected in the small chamber C5 may be reversed, so that the sound input from the hole 50*a* and the sound output from the hole 50*a* may be caused to cancel each other, so that the noise is reduced.

In the above embodiment, the arrangement of the ribs 44 in a lattice form on the top surface portion 41 has been explained. However, the arrangement of the ribs 44 may be any arrangement other than lattice form. For example, the ribs 44 may be disposed in a honeycomb shape on the top surface portion 41, or may be arranged in a triangular lattice form. Alternatively, various other shapes may also be employed. The thickness of the top surface portion 41 may be increased, and recessed portions may be formed on the top surface portion 41 and small chambers C5 may be formed.

REFERENCE SIGNS LIST

10, 10A . . . electric pump
20 . . . motor unit
21 . . . motor cover
22 . . . end cap
23 . . . rotation shaft
23*a* . . . spline shaft unit
23*b* . . . centering portion
23*c* . . . involute teeth (corresponding to male tooth portion)
26 . . . brush
27 . . . power supply bus bar
28 . . . lead line
30 . . . vane pump unit (corresponding to pump unit)
31 . . . pump plate
32 . . . rotor
33 . . . vane
34 . . . closing plate
40 . . . cover
41 . . . top surface portion
42 . . . side surface portion
44 . . . rib
45 . . . connector box
45*a* . . . insertion recessed portion
46 . . . connection unit
48 . . . connector cover
49 . . . connector bus bar
50 . . . resonator plate
51 . . . grommet
100 . . . control substrate
231 . . . rotator
232 . . . commutator
311 . . . external wall portion
313 . . . cam ring
313*a* . . . cam surface
313*c* . . . bulged portion
313*d* . . . penetration hole
315 . . . recessed engagement unit
315*a* . . . bearing engagement unit
315*b* . . . flange engagement unit
318 . . . bottom lid portion
319 . . . connection unit
322 . . . vane groove
341 . . . projection unit
342 . . . communication hole
C1 . . . rotor chamber
C2 . . . intake chamber
C3 . . . pressure chamber
C4 . . . expansion space
C5 . . . small chambers

The invention claimed is:

1. An electric pump for a vehicle, the electric pump comprising:

a motor unit including a rotation shaft;

a pump unit including a rotor having a vane groove accommodating a vane and coupled with the rotation shaft, and including a pump plate including a cam ring having an inner surface as a cam surface on which the vane slides and an external wall portion surrounding the cam ring;

a bottom lid portion provided in the pump plate and being integrally formed with the external wall portion and the cam ring, and a connection unit being provided between the external wall portion and the cam ring to connect the external wall portion and the cam ring and protruding in a direction away from the bottom lid portion, and the connection unit being integrally formed with the external wall portion, the cam ring, and the bottom lid portion;

wherein a height of an end surface at the protruding side of the connection unit from the bottom lid portion is the same as an end surface of the cam ring or lower than the end surface of the cam ring; and at a side of the pump unit opposite to the motor unit, a cover is attached in a state of covering, and the cover is attached to an end surface of the external wall portion at a side away from the motor unit, and, inside of the cover, an expansion space in which a gas compressed in the pump unit and entered through a communication hole expands is formed between the cover and the pump unit.

2. The electric pump according to claim 1, wherein a plurality of connection units are provided at predetermined intervals along an outer periphery of the cam ring.

3. The electric pump according to claim 2, wherein when the pump plate is seen in a top view, a central line of at least one of a plurality of the connection units passes a closest portion where the rotor is closest to the cam surface, and further passes a center of the cam ring.

4. The electric pump according to claim 1, wherein the pump plate is made of an aluminum-based member.

5. The electric pump according to claim 4, wherein the cam surface is formed with a coating film for improving a sliding property of the vane, and this coating film is a hard plating film of which harness is harder than that of the cam ring other than the cam surface.

6. The electric pump according to claim 5, wherein the coating film is provided so that the hardness of the coating film when a temperature of the cam ring increases is harder than that of the vane.

7. The electric pump according to claim 4, wherein at least the cam ring of the pump plate is made of an Al—SiC composite material made by adding SiC powder to aluminum or aluminum alloy.

8. The electric pump according to claim 1, wherein the cover is provided with a plurality of ribs in a protruding manner from an inner wall of the cover, a plate member is disposed at an end side of protrusions of the ribs, and a closed space is formed as being separated from the expansion space by the plate member, the ribs, and the inner wall of the cover, and the plate member is provided with a hole which allows for communication between the expansion space and the closed space.

9. The electric pump according to claim 8, wherein the ribs are provided on a top surface portion of the cover facing the pump unit at a position away from the pump unit, and the closed space is formed by attaching the plate member to the top surface portion.

10. The electric pump according to claim 9, wherein the plurality of ribs are arranged in a lattice manner on the top surface portion.

11. The electric pump according to claim 1, wherein an end surface of the connection unit at a protruding side from the bottom lid portion is disposed to be located at a side closer to an end surface of a protruding side of the cam ring than the bottom lid portion.

12. The electric pump according to claim 2, wherein the pump plate is made of an aluminum-based member.

* * * * *